United States Patent [19]

Gallucci

[11] Patent Number: 4,907,297

[45] Date of Patent: Mar. 13, 1990

[54] GLOVE

[76] Inventor: Steven Gallucci, 1140-C Parkside Green Dr., West Palm Beach, Fla. 33415

[21] Appl. No.: 206,111

[22] Filed: Jun. 13, 1988

[51] Int. Cl.[4] ..... A41D 19/00

[52] U.S. Cl. ..... 2/163

[58] Field of Search ..... 2/163, 161 R, 161 A, 2/159

[56] References Cited

U.S. PATENT DOCUMENTS

| | | | |
|---|---|---|---|
| 1,358,824 | 11/1920 | Burden . | |
| 2,263,327 | 11/1941 | Bjerke et al. | 2/163 |
| 2,335,320 | 11/1943 | Swietek | 2/163 |
| 2,513,030 | 6/1950 | Lazarian . | |
| 2,725,570 | 12/1955 | Penna . | |
| 3,224,012 | 12/1965 | Hamm . | |
| 4,416,026 | 11/1983 | Smith | 2/161 R |
| 4,519,097 | 5/1985 | Chappell, Jr. et al. . | |
| 4,748,693 | 6/1988 | Shinn | 2/161 R X |

FOREIGN PATENT DOCUMENTS

| | | | |
|---|---|---|---|
| 497129 | 8/1919 | France | 2/163 |
| 750292 | 5/1933 | France . | |
| 937147 | 3/1948 | France . | |
| 975328 | 10/1950 | France . | |
| 502658 | 3/1939 | United Kingdom | 2/163 |

*Primary Examiner*—H. Hampton Hunter

*Attorney, Agent, or Firm*—Steele, Gould & Fried

[57] ABSTRACT

A glove is provided for individuals with long fingernails. A glove is provided with a slit at the tip of the finger stall portion of the glove to just permit the nail to pass. Fastening structure such as opposing strips of Velcro can be provided on the slit to close the slit around the nail. Openings in a plurality of possible designs can be provided in the glove proximal to the slit to permit viewing the color of the nail. Other openings in the glove permit the skin of the hand to be seen.

10 Claims, 2 Drawing Sheets

FIG. 1
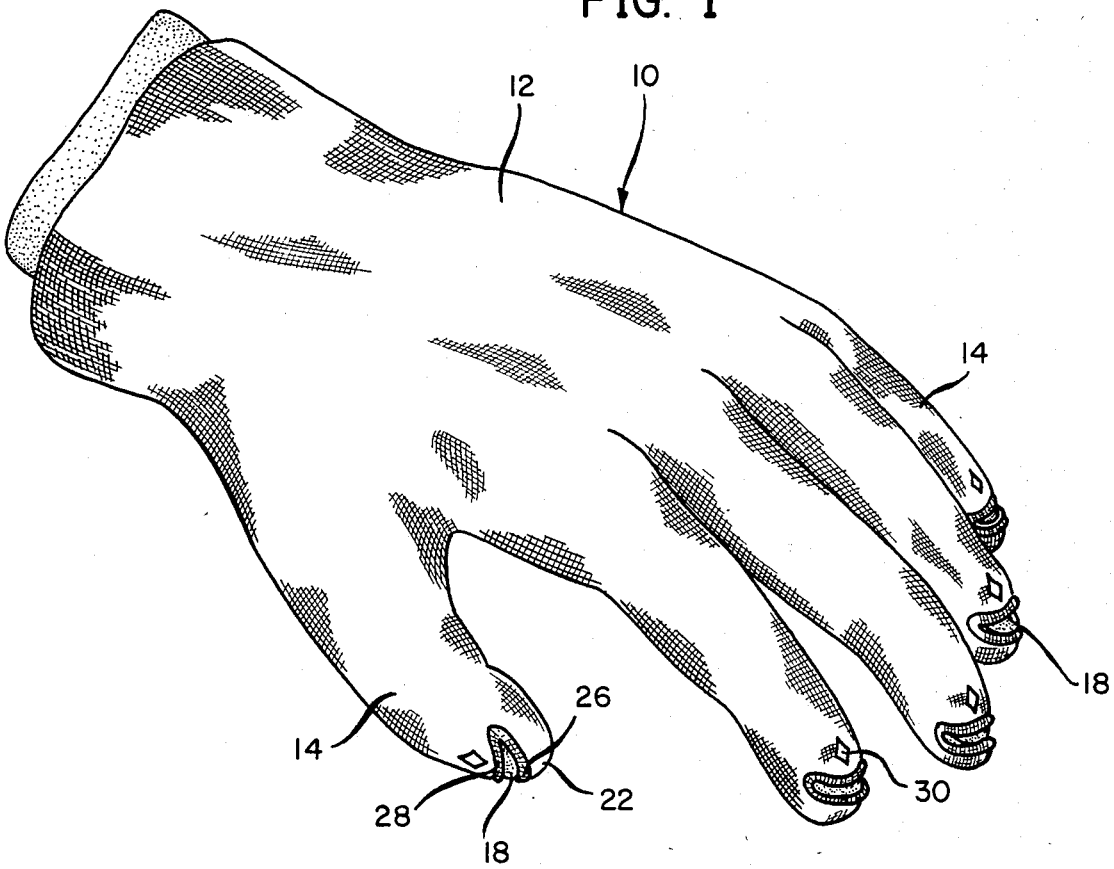
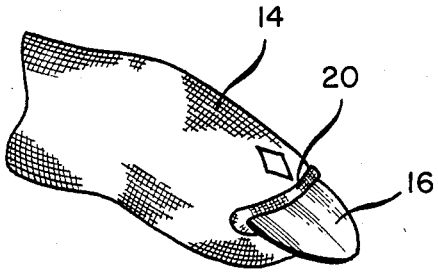
FIG. 2

GLOVE

BACKGROUND OF THE INVENTION

1. Field of the Invention

This invention relates generally to clothing, and more particularly to gloves.

2. Description of the Prior Art

There is a continuous demand for new and fashionable clothing, including gloves. A common problem for individuals with long fingernails who wear gloves is the discomfort created by the contact between the nail and the enclosed end of the glove. The hand does not fit into the glove properly. The pressure on the nail can be great when the hand is grasping tightly or holding heavy objects. This pressure can cause the nails to bend, crack, and even break.

It is known to provide openings in gloves for a variety of purposes. Some of these purposes are utilitarian, while others are more closely related to fashion. Inventions representing the former purpose include Chappel, Jr. et al, U.S. Pat. No. 4,519,097, which discloses a video game protective glove in which the fingertips are exposed for sensitivity and feel of the controls while protecting the remainder of the user's finger from abrasions, calluses, and bruises. Hamm, U.S. Pat. No. 3,224,012, discloses a bowling glove in which the non-bowling fingers are sheathed in finger portions of the glove, while the bowling fingers project freely therethrough. Other representative patents include Burden, U.S. Pat. No. 1,358,824; Gamet, French Patent No. 975.328; and Krumbiegel, French Patent No. 750.292. A representative invention of the latter category is disclosed by Lazarian, U.S. Pat. No. 2,513,030. Lazarian discloses a glove for jewelry display in which apertures are positioned such that jewelry can project through the glove where it can be seen by others. Einhorn, French Patent No. 937.147 is also representative of this class.

Penna, U.S. Pat. No. 2,725,570, discloses a ladies glove in which a number of openings in the finger stalls expose the fingernails of the wearer. Transparent covers can be provided to cover the openings. The openings expose substantially the entire nail and subject the nail to abrasion and damage even when the glove is worn. Penna does not disclose a means for adjusting the size of the opening to suit the wearer.

It would be desirable to provide a new and fashionable type of glove. It would also be desirable to provide a glove for individuals with long fingernails whereby the fingernails could project through the tip of the finger stall to allow the glove to fit properly and to increase the comfort of the wearer. It would further be desirable to provide a glove which would substantially protect the nail while permitting others to view a substantial portion of the color of the nail. It also would be desirable to provide a glove which would be adjustable to the dimensions of the wearer's fingernails.

SUMMARY OF THE INVENTION

It is an object of the invention to provide a new and fashionable glove.

It is a further object of the invention to provide a glove which will prevent long nails from abutting the tip of the finger stalls.

It is another object of the invention to provide a glove which will increase the comfort of the wearer who has long nails.

It is yet another object of the invention to provide a glove which will be adjustable to fit the dimensions of the nails of the wearer.

It is still another object of the invention to provide a glove which will substantially protect the nail while permitting others to view a substantial portion of the color of the nail.

These and other objects are accomplished by a glove having slits in the tips of the finger stalls to permit the passage of long nails. The slits are dimensioned to nearly the dimensions of the fingernails. The portion of the nail extending beyond the finger tip extends through the slit, while the remaining portion of the nail is protected by the glove against abrasion and damage. Reinforcement material such as thin wire or durable materials can be provided to line the slit for added strength and durability. Fastening structure such as opposing strips of a hook and loop fastener such as Velcro can be provided on opposing edges of the slit to close the slit to near the cross-sectional dimensions of the wearer's nails.

Additional structure can be provided to permit viewing the color of the portion of the nail that is protected by the glove. A viewing aperture can be formed adjacent and proximal to the slit, through which the color of the nail can be seen. The viewing aperture is smaller in plan area than the portion of the nail proximal to the slit. The surrounding glove material will protect the nail surface from damage and abrasion. The viewing aperture can be styled in any number of fasionable designs to enhance the beauty of the glove. Still other openings can be provided in the glove for styling which permit the viewer to see the wearer's skin and which serve as a format for fashionable designs.

BRIEF DESCRIPTION OF THE DRAWINGS

There are shown in the drawings embodiments which are presently preferred it being understood, however, that the invention is not limited to the precise arrangements and instrumentalities shown, wherein:

FIG. 1 is a perspective view of a glove according to the invention.

FIG. 2 is a perspective view of a finger stall of the glove as worn.

FIG. 3 is a plan view of a glove according to the invention as worn.

FIG. 4 is a perspective view of an alternative embodiment.

DETAILED DESCRIPTION OF THE PREFERRED EMBODIMENTS

A glove according to the invention is shown in FIGS. 1-3. The glove 10 has a palm portion 12 and finger stalls 14. A lateral slit 18 is provided at the upper portion of the tips 22 of the finger stalls 14. The slits 18 are dimensioned so as to approximate the cross-sectional dimensions of the wearer's nails so that the fingernails just pass through. The term "slit" as used herein defines an aperture, the lateral width of which is far in excess of the longitudinal width. The lateral width of the slit is preferably at least four times the longitudinal width of the slit. The slits 18 permit the nail 16 to extend through the tips 22 of the finger stalls 14. A reinforcing cord 20, including thin wire or another durable material, can line the edges of the slits 18 to prevent sagging and tearing.

The slits 18 define distal edges 26 farthest away from the palm 12 and proximal edges 28 closest to the palm 12. The portion of the nail 16 extending beyond the tip of the finger is distal to the slit 18. The portion of the nail 16 proximal to the slit 18 is protected by the glove 10. Viewing apertures can be formed in the finger stalls proximal to the slits 18 to permit the color of the proximal portion of the nail to be seen. The viewing apertures are preferably smaller in plan area than the proximal portion of the nail. The surrounding glove material will protect the nail surface from damage and abrasion. The viewing apertures can be styled in any number of fashionable designs including the diamond shapes 30. Additional designs could include the heart 32, the stripes 36, the star 38, and the clover leaf 40.

Additional openings in the glove 10 can be provided to make the glove more fashionable. Examples are the clover leaf openings 42 disposed about the longitudinal length of the finger stall 14 of the little finger (FIG. 3). Still other openings can be provided in other portions of the glove, such as the large clover leaf 44 in the palm portion 12 of the glove 10.

In a further embodiment shown in FIG. 4, fastening means such as opposing strips of a hook and loop fastener such as Velcro can be provided to close the slit about the fingernail. Flaps 50 and 52 can be provided and are spaced circumferentially from one another about the slit 18. The flaps 50, 52 have cooperating fastening means to permit their attachment to one another, preferably at a plurality of circumferential positions so that the circumference of the slit 18 can be adjusted by adjusting the relative positions of the flaps 50, 52 with respect to one another. The fastening means is preferably opposing strips of a hook and loop fastener such as the hook surface 56 on the flap 50 and the loop surface 60 on the flap 52. The slit 18 can be closed about the nail 16 by pulling the flaps 50, 52 to a position where the slit 18 nests snugly about the nail 16, whereupon the flaps 50, 52 can be fastened together to secure the slit 18 at that circumferential dimension.

The glove can be formed from any material suitable for this purpose, including leather, suede, cotton, knit materials, and lace. The reinforcing material can be formed from several suitable materials including thin wires and strong synthetic cord materials such as nylon.

This invention can be embodied in other forms without departing from the spirit or essential attributes thereof, and accordingly, reference should be made to the following claims, rather than to the foregoing specification, as indicating the scope of the invention.

I claim:

1. A glove having a palm portion and finger stall portions with enclosed tips, comprising:

a slit in each tip portion adapted to permit the passage of the tip of a fingernail, said slit having a longitudinal dimension slightly in excess of the thickness of the fingernail of the wearer, said dimension being aligned with the long axis of the finger stall, said slit having a lateral dimension perpendicular to said longitudinal dimension, said lateral dimension being slightly in excess of the lateral dimension of said fingernail.

2. The glove of claim 1, wherein said slits define a proximal edge and a distal edge, fastening means being provided to secure opposing portions of said proximal edge to said distal edge to close said slit to near the cross-sectional dimensions of the fingernail of a wearer.

3. The glove of claim 2, further comprising an aperture proximal and adjacent to said slit, whereby the color of the nail proximal to the slit can be viewed and surrounding glove material will protect the nail from damage and abrasion.

4. The glove of claim 3, further comprising a reinforcing member disposed about the slit.

5. The glove of claim 3, further comprising at least one additional aperture in the glove, said aperture being positioned over the skin of the wearer.

6. The glove of claim 1, further comprising an aperture proximal and adjacent to said slit, whereby the color of the nail proximal to the slit can be viewed in a plurality of designs, and surrounding glove material will protect the nail from damage and abrasion.

7. The glove of claim 6, wherein said slits comprise fastening means adapted to close said slit about the fingernail of the wearer.

8. The glove of claim 7, wherein the fastening means comprises opposing flaps spaced circumferentially apart about the slit and having cooperating fastening means for securing said flaps to each other in a plurality of circumferential positions.

9. The glove of claim 8, wherein said fastening means comprise cooperating hook and pile surfaces.

10. The glove of claim 1, wherein said lateral dimension of said slit is at least four times the longitudinal dimension of said slit.

* * * * *